US007779851B2

(12) United States Patent
Mallookis et al.

(10) Patent No.: US 7,779,851 B2
(45) Date of Patent: Aug. 24, 2010

(54) STRUCTURAL SUPPORT MEMBER

(75) Inventors: Steven E. Mallookis, Littleton, CO (US); Chao-Shun Ko, Taipei (TW)

(73) Assignee: Ming-Liang Tsui, part interest ( * ) Notice: Subject to any disclaimer, the term of this patent is extended or adjusted under 35 U.S.C. 154(b) by 1007 days.

(21) Appl. No.: 11/301,981

(22) Filed: Dec. 13, 2005

(65) Prior Publication Data

US 2006/0130887 A1 Jun. 22, 2006

Related U.S. Application Data

(63) Continuation-in-part of application No. 10/983,005, filed on Nov. 5, 2004, now Pat. No. 7,409,963.

(51) Int. Cl.

| | |
|---|---|
| ***E04H 15/60*** | (2006.01) |
| ***F16L 9/19*** | (2006.01) |
| ***E04C 3/00*** | (2006.01) |

(52) U.S. Cl. ..... 135/114; 135/115; 135/117; 52/843

(58) Field of Classification Search ..... 52/843; 138/115, 117; 29/897.31, 897.312, 897.33, 29/897.35; 135/114

See application file for complete search history.

(56) References Cited

U.S. PATENT DOCUMENTS

| | | | | |
|---|---|---|---|---|
| 2,929,408 | A * | 3/1960 | Smith et al. | 138/38 |
| 5,409,215 | A * | 4/1995 | You | 473/521 |
| 5,450,703 | A * | 9/1995 | Fuhrman et al. | 52/843 |
| 5,471,809 | A | 12/1995 | Frankel | |
| 6,532,712 | B2 | 3/2003 | Kawasaki et al. | |
| 6,575,198 | B2 * | 6/2003 | Yoshitoshi et al. | 138/115 |
| 6,655,633 | B1 | 12/2003 | Chapman, Jr. | |
| 6,929,035 | B2 * | 8/2005 | Debaisieux et al. | 138/115 |
| 7,048,122 | B2 * | 5/2006 | Dodson et al. | 206/443 |

* cited by examiner

*Primary Examiner*—David Dunn
*Assistant Examiner*—Danielle Jackson
(74) *Attorney, Agent, or Firm*—The Reilly Intellectual Property Law Firm, P.C.; Ellen Reilly; John E. Reilly

(57) ABSTRACT

An elongated structural support member for truss sections of collapsible shelters having a cellular core structure including internal dovetailed wall portions and an internal medial wall portion joined at opposite ends to the dovetailed wall portions.

5 Claims, 5 Drawing Sheets

STRUCTURAL SUPPORT MEMBER

CROSS-REFERENCE TO RELATED APPLICATIONS

This application is a continuation-in-part of patent application Ser. No. 10/983,005, filed 5 Nov. 2004 now U.S. Pat. No. 7,409,963 for CORNER MOLDING AND STOP ASSEMBLY FOR COLLAPSIBLE SHELTERS by Steven E. Mallookis and Chao-Shun Ko and incorporated by reference herein.

BACKGROUND

This article of manufacture relates generally to an elongated structural support; and more particularly to a novel and improved structural support member for a collapsible shelter having a cellular core structure characterized by its high strength and ability to withstand a combination of axial bending stresses and tensile loading as well as torsional forces. A structural support member may be used in combination with an adjustment assembly and improved mounting members to provide for an improved collapsible shelter with added stability and strength.

Modern load-bearing supports for canopies, shelters, umbrellas and the like need to be lightweight yet also capable of sustaining loading forces, such as, gravity, winds and other forces. Hollow stainless steel members which have been used in the past, are heavy and must withstand high wind speeds and structural loads while efficiently and inexpensively reinforcing the load carrying capacity of the structural member. The following article of manufacture is a novel and improved structural support member which is lightweight yet is able to withstand multidirectional forces.

The following embodiments and aspects thereof are described and illustrated in conjunction with systems which are meant to be exemplary and illustrative, not limiting in scope.

SUMMARY

The embodiments set forth are exemplary and not for purposes of limitation. The present embodiments are designed to provide a novel and improved elongated structural support member to be integrated in a load carrying structure, such as, a truss. The present embodiments provide a structural support member for shelters, canopies, chairs, umbrellas and are not limited to these but are given by way of example.

In accordance with the present embodiments, there is provided an elongated structural support member having a cellular core structure of generally oblong cross-sectional configuration, the cellular core structure including an outer rigid shell and internal dovetailed wall portions at opposite ends of the shell and an internal medial wall portion joined at opposite ends to the dovetailed wall portions. There is further provided a collapsible frame shelter including vertical support legs, a telescoping center support member and truss sections extending between the vertical support legs, the center support end having slidable mounting members located on an upper end of the vertical support legs, the mounting members each having at least two bosses with a bore therethrough, arm members including an aligned bore pivotally mounted in juxtaposition to the bosses, vertical support legs having mutually aligned bores, position locking members located on the mounting members and the truss sections defined by a plurality of elongated structural support beams each having an outer rigid shell and internal dovetailed wall portions at opposite ends of the shell and an internal medial wall portions joined at opposite ends to the dovetailed wall portions.

In addition to the exemplary aspects and embodiments described above, further aspects and embodiments will become apparent by references to the drawings and by study of the following descriptions.

BRIEF DESCRIPTION OF THE DRAWINGS

Exemplary embodiments are illustrated in reference to Figures of the drawings. It is intended that the embodiments and Figures disclosed herein are to be considered illustrative rather than limiting.

DETAILED DESCRIPTION

Figure 1:
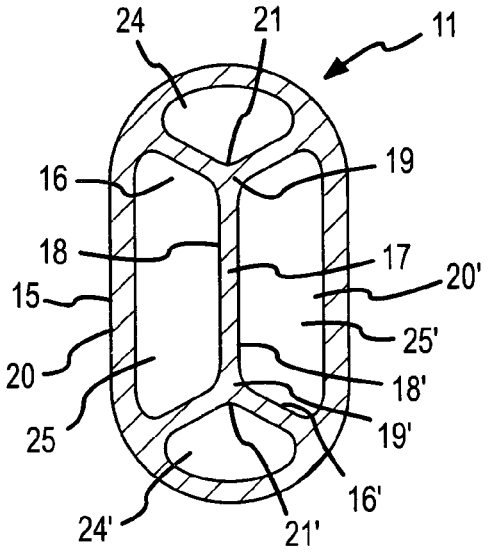
FIG. 1 is a cross-sectional view of an elongated structural support according to one embodiment.
Figure 2:
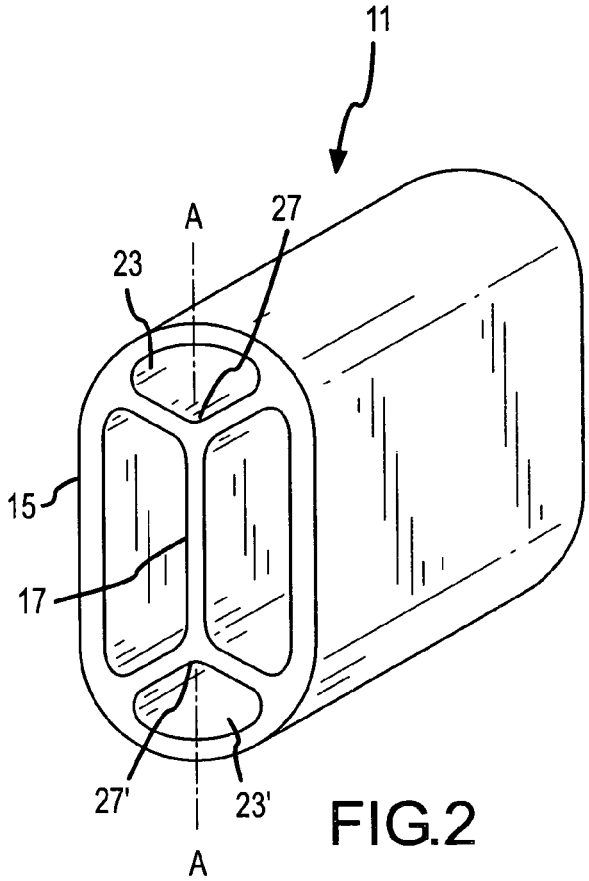
FIG. 2 is a perspective view of the embodiment shown in FIG. 1.

An elongated structural support 11 for a collapsible shelter is illustrated generally in FIGS. 1-8 and one embodiment is shown in FIGS. 1 and 2 wherein the support member 11 includes an elongated or tubular element having an oblong or oval configuration. The support member or beam 11 may also have a circular or rectangular configuration to name a few. The support beam 11 may be used as a framework in collapsible shelters or other fixed and folding frameworks. These are set forth in FIGS. 5 and 7.

Broadly, the cellular core structure or honeycomb configuration is formed from a medial wall portion 17 having a continuous series of upwardly and downwardly projecting extensions forming generally polygonal areas. It will be recognized that termination of the extensions in slightly rounded flat surfaces will cause variance in the cross-sectional forms.

In the embodiment shown in FIGS. 1 and 2, the cellular core structure 13 includes an outer rigid shell 15 and an internal medial wall portion 17 joined at opposite ends 19, 19' to dovetailed wall portions 21, 21'. The dovetailed wall portions 21, 21' are generally symmetrical about a major axis A through the medial wall portion 17. The outer shell 15 is of generally oval configuration but may also be of circular, rectangular or various other configurations as set forth earlier. The dovetailed wall portions 21, 21' are disposed symmetrically about a major axis A of the shell 15. These are offered by way of example and not limitation. With continued reference to FIG. 2, the dovetailed wall portions 21, 21' also are positioned symmetrically in inverted relation to one another and adjoining ends of said dovetailed portions are joined to each end of the medial wall portion 17. The dovetailed portions 21, 21' form obtuse angles to the medial wall portion 17, optimally. The dovetailed portions 21, 21' each may form a generally conical recess or Y-shaped configuration 24, 24' at each opposite end 23, 23' of the shell 15. The dovetailed wall portions 21, 21' and the medial wall portion 17 define polygonal recesses 25, 25' on opposite sides of the medial wall portion 17. Optimally, the angle of intersection between inner walls 16, 18 and 16', 18' of the polygonal recesses 25, 25' at the opposite ends 19, 19' is greater than 90°. The angle of intersection between outer walls 20, 20' of the polygonal recesses 25, 25' and the inner walls 16, 16' is less than 90°. As a result, the recesses 25, 25' are of generally trapezoidal shape. Dovetailed wall portions 21, 21' form obtuse angles at the intersection points 27, 27' with the medial wall portion 27. The polygonal recesses 25, 25' formed as a result of the intersection between the dovetailed portions and the medial wall, as well as the Y-shaped recesses 24, 24', cooperate to provide a support member with load carrying capacity.

The elongated structural support member 11 is formed of aluminum alloy, titanium alloy, Fiberglass, steel or other types of materials. Titanium typically has maximum stress levels of about 150,000 psi while aluminum has maximum stress levels up to 90,000 psi depending upon the alloy mixture. Fiber material has maximum stress levels of about 600,000 psi to 1,000,000 psi. The type of material chosen for the support member 11 is dependent upon the stress levels required, the expense and the characteristics desired, i.e., lightweight. The support beam 11 forms a truss member capable of withstanding multi-directional stresses. The support members 11, 41 are typically formed by the extrusion process used by those skilled in the art. This structure can also be formed by, but is not limited to, casting, diffusion bonding and filament winding. The formation of the profiled metal shapes may be varied depending upon the structure desired. The cellular structure of the design allows for variance in the load-carrying capability along different planes while also providing for a lighter weight framework.

Further, the cross-sectional configuration of the support member 11 will dictate the areas of greater load carrying capacity. For example, a support beam having a cross-sectional configuration including generally conical recesses at each opposite end 23, 23' of the shell 15 provides greater load carrying capacity at each vertical end preventing buckling or breaking of the support beam at localized areas of highly concentrated loads. In this situation, the load-bearing capacity is greater along the vertical plane than the lateral plane. A smaller cross-sectional area is provided at these points. Based upon the expected loading characteristics of a structural framework, the geometry of the structural support member 11 can be used to efficiently carry the expected stresses. Furthermore, the cellular core structure must have cooperating elements forming the support member 11 which can resolve stresses generated from more than one direction. For example, a shelter assembly must be designed in such a way to efficiently withstand forces within a truss such as bending, deflection and shear as well as torsional, rotational, compression bending and tension stresses.

Figure 3:
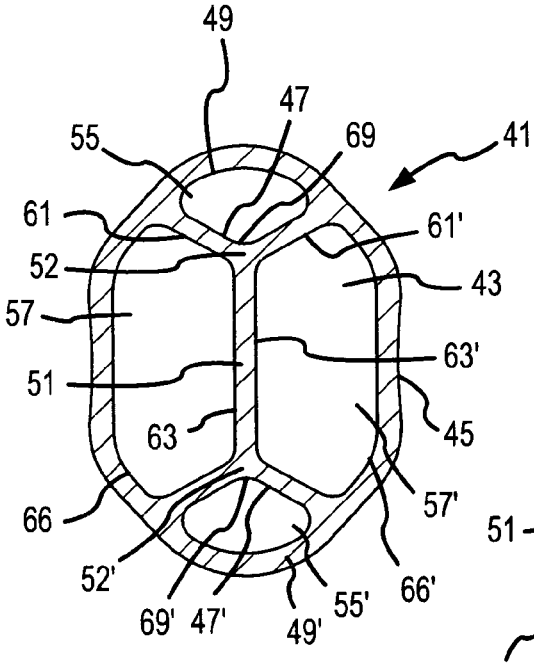
FIG. 3 is a cross-sectional view of a structural support according to another embodiment.
Figure 4:
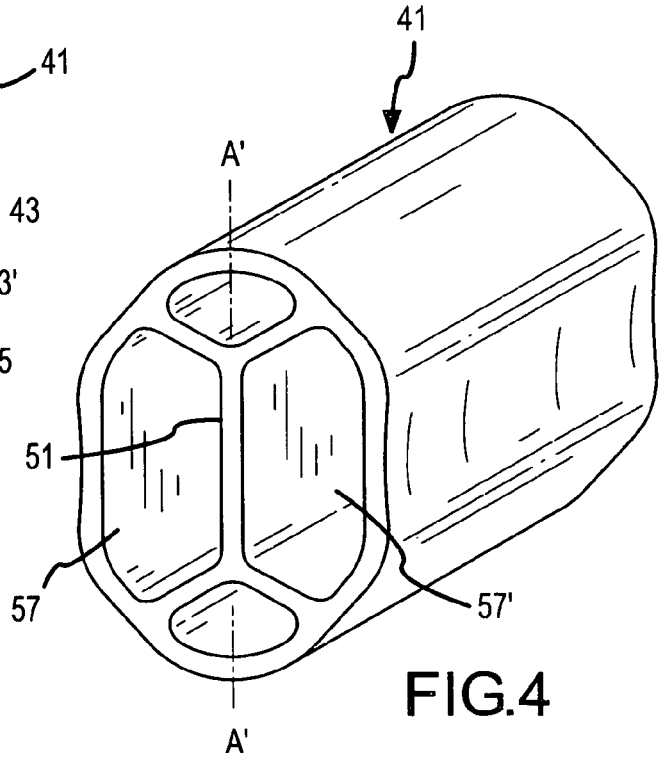
FIG. 4 is a perspective view of the embodiment shown in FIG. 3.

A further embodiment as shown in FIGS. 3 and 4 includes an elongated structural support member 41 having a cellular core structure 43 of generally oblong cross-sectional configuration including an outer rigid shell 45, internal dovetailed wall portions 47, 47' at opposite ends 49, 49' of the shell 45 and an internal medial wall portion 51 joined at opposite ends 52, 52' to the dovetailed wall portions 47, 47'. The dovetailed wall portions are symmetrical about a major axis A' and form generally conical recesses 55, 55' at each opposite end of the shell. The shell 45 is of generally oblong or oval-shaped configuration and the dovetailed wall portions 47, 47' and medial wall portion 51 form generally rhombus-shaped recesses 57, 57' on opposite sides of the medial wall 51. The angles of intersection between inner walls 61, 61' and 63, 63' of the recesses 57, 57'. In contrast with the prior embodiment, the angles of intersection between outer walls 66, 66' and the inner walls 61, 61' of the recesses 57, 57' form obtuse angles. The dovetailed wall portions 47, 47' form obtuse angles at intersection points 69, 69' with the internal medial wall portion 51.

Figure 5:
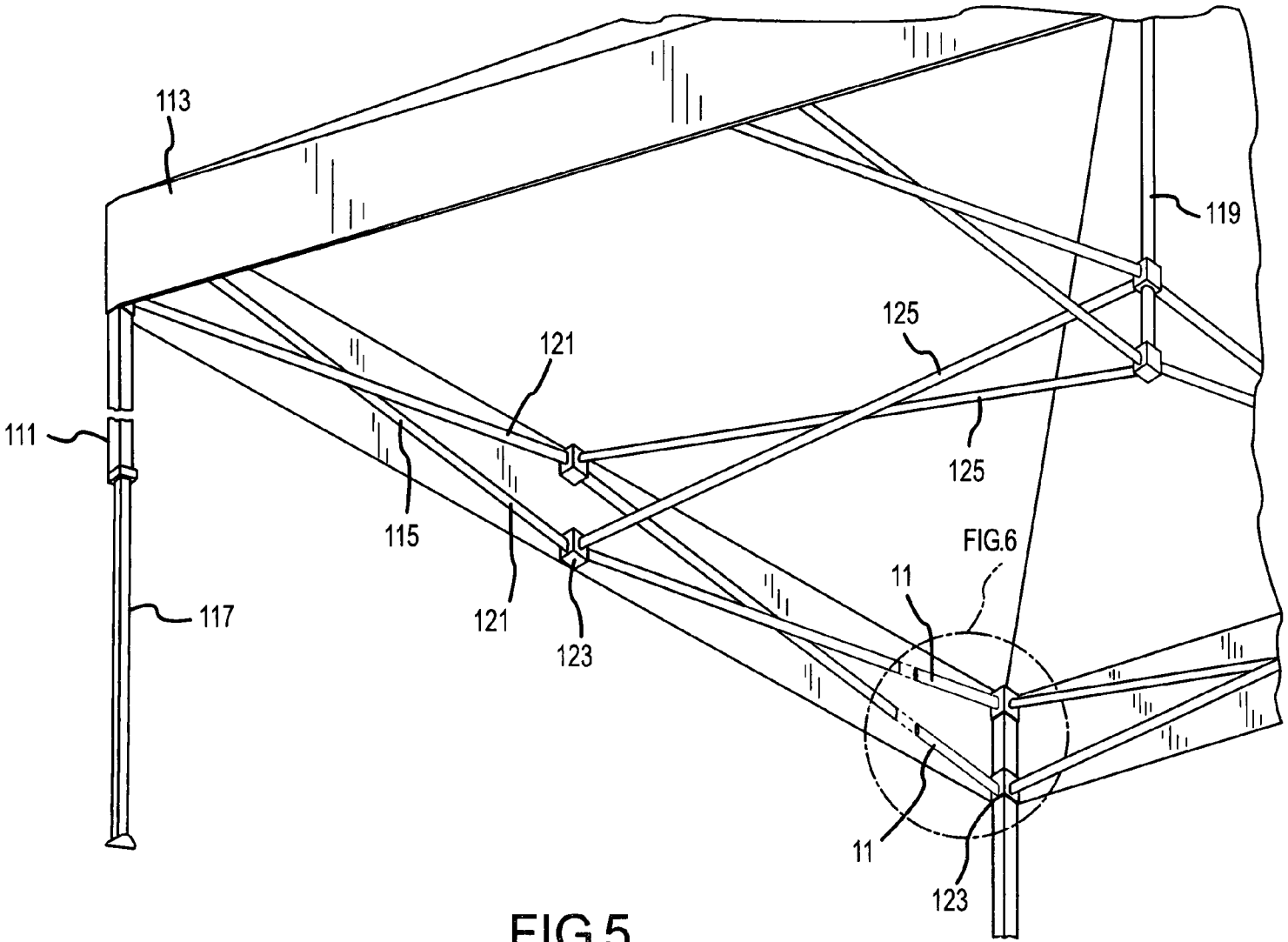
FIG. 5 is a perspective view of a shelter assembly.
Figure 6:
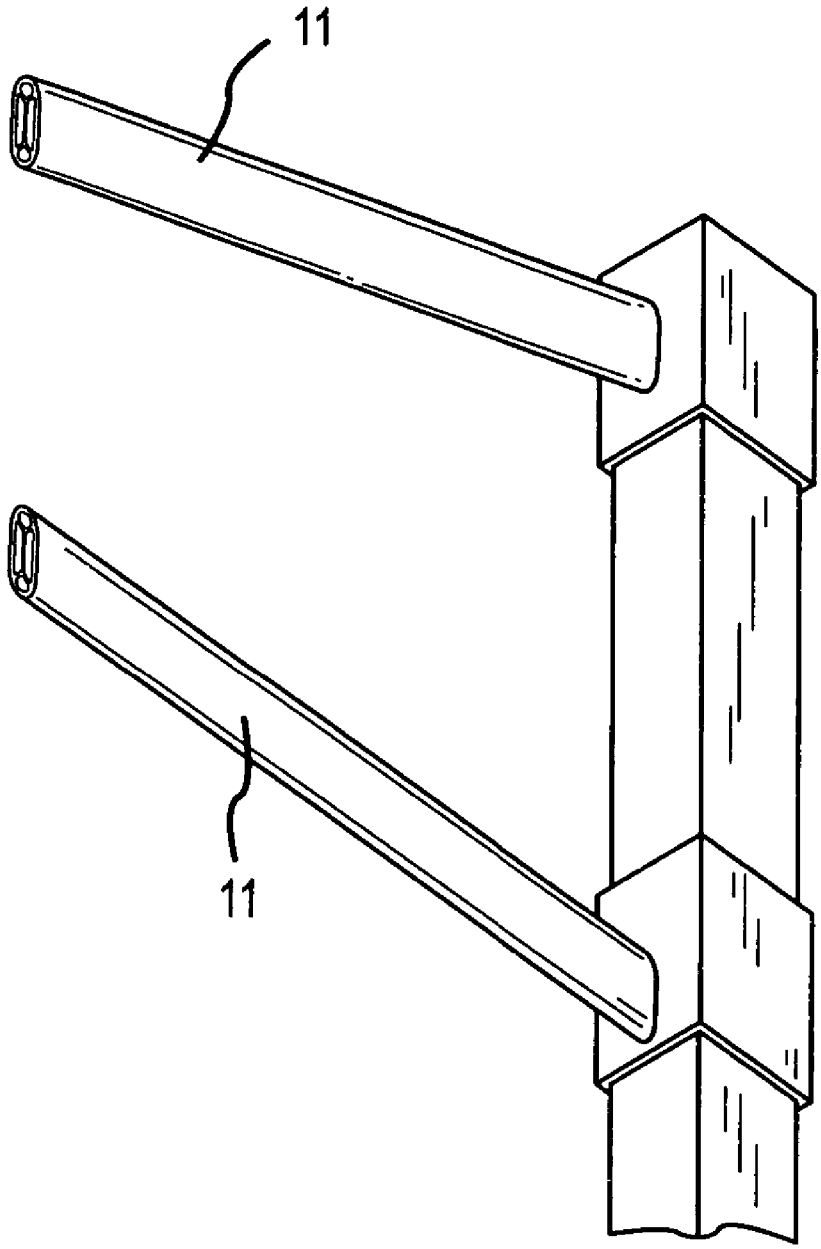
FIG. 6 is a view partially in section of FIG. 5.
Figure 7:
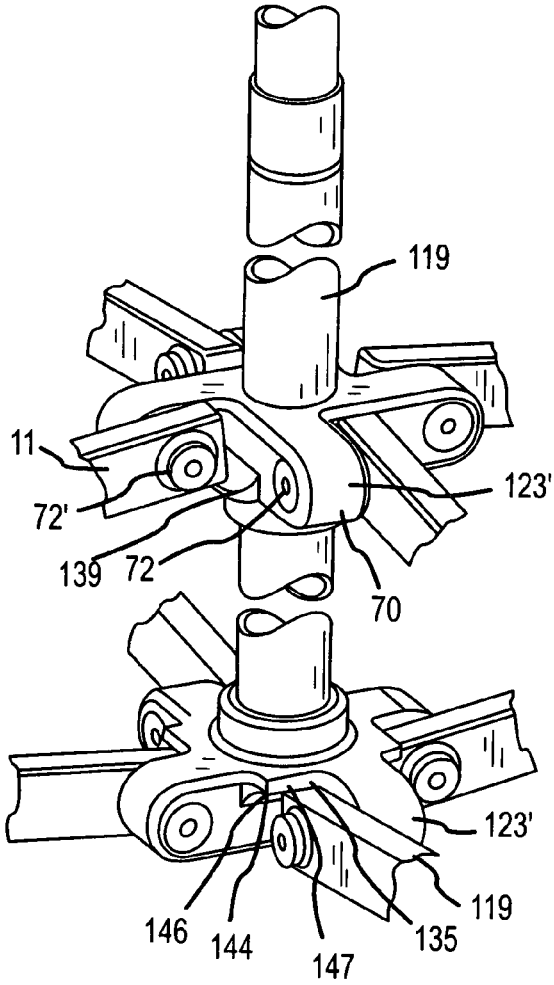
FIG. 7 is a perspective view of a center mount assembly.
Figure 8:
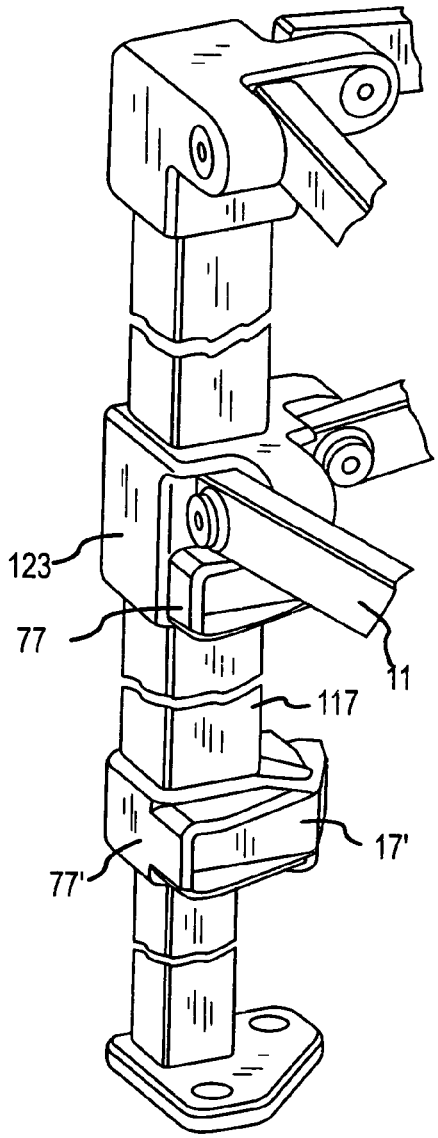
FIG. 8 is a perspective view of a side mount assembly.

The support beam may be used as framework in canopies, chairs, benches, hammocks, carriages and other fixed and folding frameworks. An example of this is shown in FIGS. 5 and 7. FIG. 5 is a view of one symmetrical half of a collapsible shelter with FIG. 6 demonstrating a partial cross-section of the support beam 11. The collapsible shelter 111 includes a canopy 113 and a frame 115 with support members including vertical, telescoping support legs 117 at spaced peripheral intervals beneath the canopy, a center telescoping support 119 extending upwardly from the frame into engagement with an undersurface portion of the canopy at its center, scissors-like truss sections 121, 125 defined by a pair of elongated support beams 11 pivotally interconnected to one another and extending between the vertical support legs and between the center support and mounting members 123 and lower terminal ends 127 mounted on the center support 119 and the vertical legs.

Figure 9:
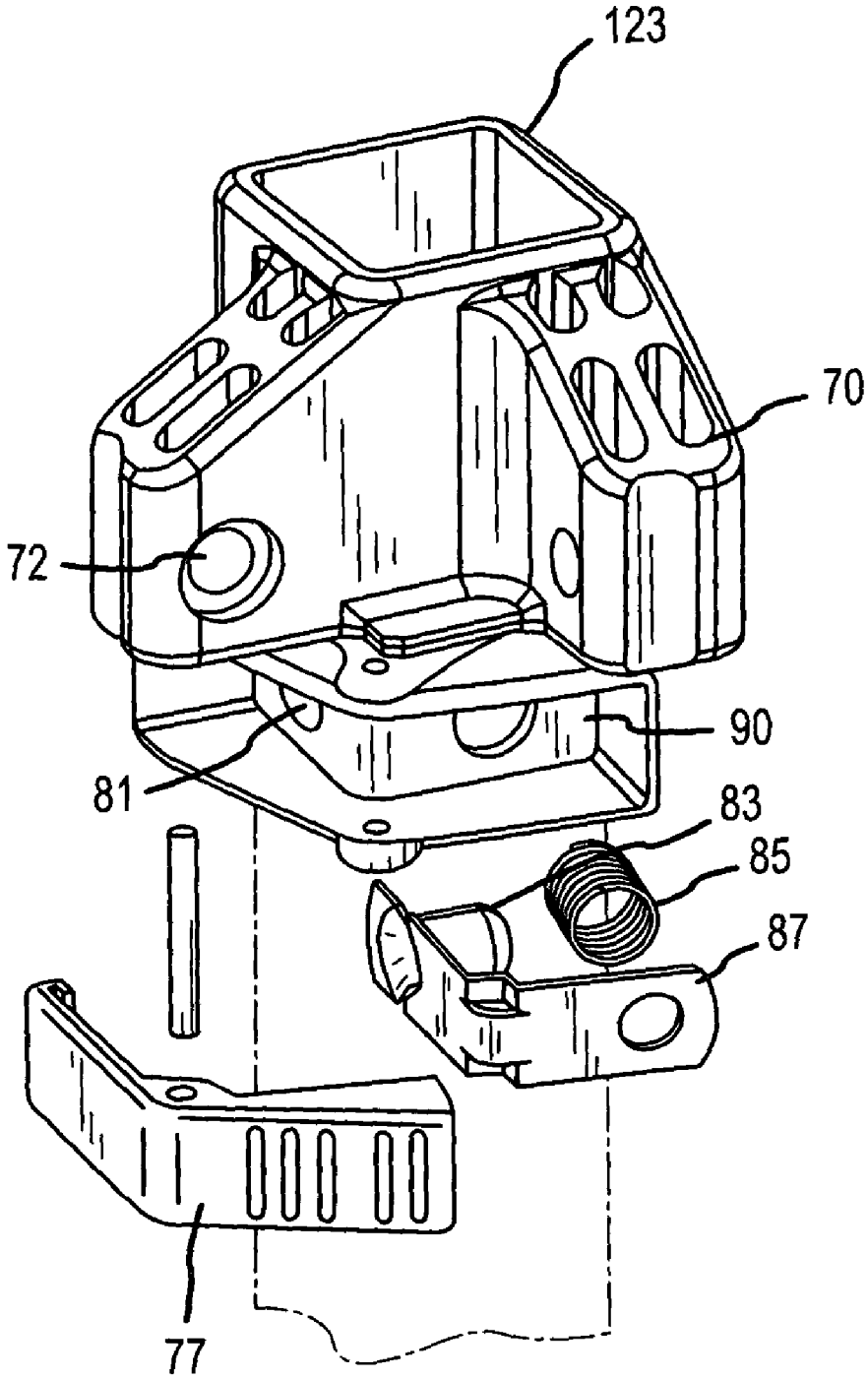
FIG. 9 is a perspective view of a mounting member.

The mounting members 123 are secured by terminal ends of the truss sections to the support members, each of the mounting members having at least one boss 70 with a bore 72 therethrough and the sections including aligned bores pivotally mounted in juxtaposition to the bosses. See FIGS. 7 and 8. The mounting members 123 include a stabilizer member which is in the form of stop members 139 and 144 juxtaposed to each boss 70. The stop member 144 extends laterally outwardly from a side of the boss 70. The stop member 144 has an upper inclined portion 147 providing a release surface for terminal ends 135 of arm members 119 and a lower, outwardly extending portion 146 as shown in FIG. 7. The shelter also includes position locking members 77 on said mounting members for increasing the angle of extension between the vertical, telescoping support legs and the arm members. See FIGS. 8 and 9. The vertical support legs have mutually aligned bores and the position locking members are defined by a spring member 85 mounted under compression between a pin lever 87 and a base mounting member 90, the spring member resiliently urging the pin lever member in a direction causing a retention pin 83 mounted on the opposite end of the pin lever member to engage with the aligned bores 81. The telescoping support legs 117 are provided with an adjustable locking member 77' to regulate the length of extension of height of the canopy. In accordance with standard practice, the scissors-like truss sections 121 and 125 are collapsible and extendable by adjusting position locking members 77. Incorporation of the support beam 11 into the truss sections 121 and 125 provides for a load-bearing member able to withstand multidirectional stresses.

The configurations described are by way of example and not limitation and these configurations have been found to provide a high strength structure capable of withstanding high compressional forces but also capable of withstanding high shear forces. It has also been found that polygonal recesses at opposite ends of an elongated support beam provide maximum strength along a major axis where torsional forces can be higher in a truss bar of a shelter. It is obvious that the polygonal recesses may assume a number of different shapes, such as, triangle, trapezoid, diamond, parallelogram or rhombus to obtain maximum strength in a selected direction.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and subcombinations as are within their true spirit and scope.

We claim:

1. A structural support comprising:

a first pair of hollow polygonal tubular sections juxtaposed to one another, each said tubular section sharing a single inner common wall therebetween and outer parallel walls, said inner common wall extending the greater length of said tubular sections; and a second pair of polygonal hollow tubular sections juxtaposed on each end of said first polygonal tubular sections having inner walls adjoining opposite ends of said common wall in a generally Y-shaped configuration.

2. The structural support according to claim 1 wherein said inner common wall of said first polygonal tubular sections intersects inner walls of said second polygonal tubular sections forming obtuse angles therebetween.

3. The structural support according to claim 1 wherein said first pair of hollow polygonal tubular sections are of generally trapezoidal configuration.

4. The structural support according to claim 1 wherein said first hollow polygonal tubular sections are of generally rhomboid configuration.

5. The structural support according to claim 1 wherein said first polygonal tubular sections are of a cross-sectional dimension greater than said second hollow tubular sections.

* * * * *